United States Patent [19]

Rericha

[11] Patent Number: 4,736,865

[45] Date of Patent: Apr. 12, 1988

[54] ENGINE BLOCK PLUG

[75] Inventor: Brian F. Rericha, Downers Grove, Ill.

[73] Assignee: Microdot Inc., Darien, Conn.

[21] Appl. No.: 63,824

[22] Filed: Jun. 19, 1987

[51] Int. Cl.[4] ..... B65D 39/04

[52] U.S. Cl. ..... 220/307

[58] Field of Search ..... 220/307; 411/44, 45, 411/46

[56] References Cited

U.S. PATENT DOCUMENTS 3,623,628 11/1970 Rericha ..... 220/307

4,202,463 5/1980 Mogler ..... 220/307

FOREIGN PATENT DOCUMENTS 1351352 12/1963 France ..... 220/307

118416 12/1969 Norway ..... 220/307

*Primary Examiner*—Donald F. Norton

*Attorney, Agent, or Firm*—Lyman R. Lyon

[57] ABSTRACT

An engine block plug having a cylindrical grommet provided with a radially extending flange, a central longitudinal radially inwardly tapering aperture with an internal circumferential groove and an insert having a radially inwardly tapering outer surface, a narrow end and a radially outwardly extending flange preassembled within the internal groove. The assembly is inserted into the block port and the insert is driven further into the grommet to expand the grommet to seal the engine block port.

9 Claims, 2 Drawing Sheets

ENGINE BLOCK PLUG

BACKGROUND OF THE INVENTION

The instant invention relates to plugs used to seal the fluid ports of an engine block.

The prior art teaches the use of freeze plugs comprised of a solid piece of metal, wood or plastic typically having an outer surface formed in the shape of a conical frustum. The port is sealed by forcibly inserting the plug therein. As the fluid contained within the engine block begins to expand upon freezing, the plug is dislodged from the port by the increased pressure incident to such expansion, and the freezing fluid is able to escape the confines of the engine block, thereby avoiding engine block damage. Unfortunately, the pressure at which the plug is forced from the port cannot be consistently predicted, since the installation of the plug damages the mating surfaces of both the plug and the engine block port, thereby providing an indeterminate additional amount of frictional contact therebetween. The force due to the frictional contact is exacerbated at temperature extremes by the disparity in the coefficients of thermal expansion for the engine block and plug materials.

Alternatively, the prior art teaches the use of pipe plugs comprising a solid element characteristically formed of metal having an externally threaded surface. The pipe plug is threadably inserted into an engine block port that has been tapped to receive the threaded portion of the plug, whereby the port is sealed. The pipe plug must be carefully advanced into the engine block so as to avoid damage thereto from overtightening. Cross-threading is frequently encountered, and irreparable damage to the engine block is not uncommon, where the plug is formed of a harder material than the engine block, such as the use of an iron plug in an aluminum block and where the plugs are inserted and advanced by machine. Moreover, sealant applied to the threaded portion of the pipe plug is frequently removed during automated insertion thereof into the engine block port, thereby generating leak paths that reduce seal effectiveness.

SUMMARY OF THE INVENTION

The engine block plug of the instant invention features ease of installation, a positive engine block seal with a consistent release pressure, and reduced incidence of engine block damage during installation.

The invention comprises a cylindrical grommet formed of an elastic material and a frusto-conical insert characteristically formed of a polymeric substance. The cylindrical grommet is provided on one end with a radially outwardly extending flange and a radially inwardly tapering central aperture extending longitudinally therefrom. The peripheral wall of the aperture is additionally provided with an internal circumferential groove. The insert has a radially outwardly extending flange on its narrower end that is of like diameter as the circumferential groove formed in the aperture of the grommet.

The insert is preassembled with the grommet prior to installation into a circular engine block port having a back angle preferably between 10° and 15°, or an internally facing counterbore. The insert is intromitted flange-first into the central aperture of the grommet so as to position its flange securely within the circumferential groove therein. The plug assembly is then positioned within the engine block port so as to place the flange of the grommet incontiguity with the outer surface of the engine block. The grommet is expanded radially outward by driving the insert to its fully inserted position, wherein the insert is maintained by resilient action of the grommet and by opposition of a longitudinal face of the insert's flange with a grommet surface of suitable configuration.

DETAILED DESCRIPTION OF THE PREFERRED EMBODIMENT OF THE INVENTION

Figure 1:
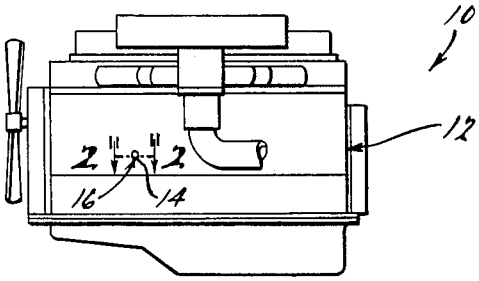
FIG. 1 is a side view in elevation of an internal combustion engine.
Figure 2:
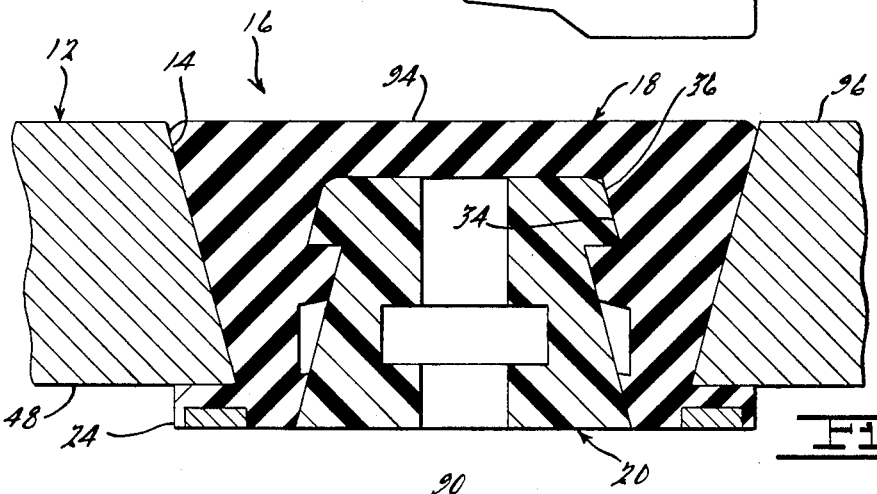
FIG. 2 is a view in cross section of the engine block plug assembly of the instant invention installed in a port in the engine block along line 2—2 of FIG. 1.
Figure 3:
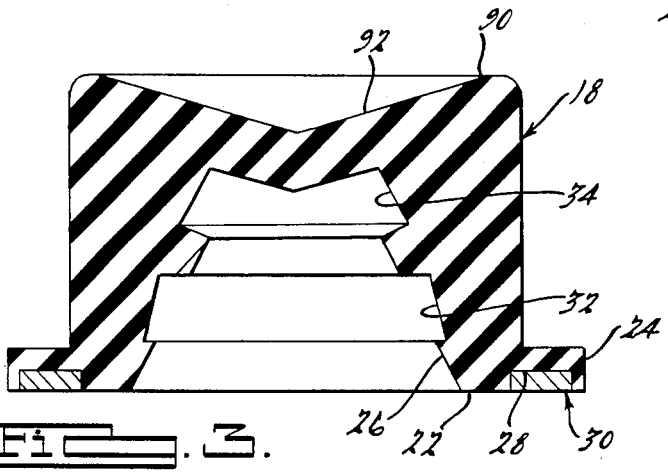
FIG. 3 is a view in cross section of the grommet of the plug assembly of FIG. 2.

FIG. 1 shows an internal combustion engine 10 comprising an engine block 12 having a circular oil channel port 14 which is sealed with an engine block plug assembly 16 constructed in accordance with the instant invention. Referring to FIG. 2, the engine block plug assembly 16 comprises a cylindrical grommet 18 characteristically formed of an elastic material and an insert 20 characteristically formed of a polymeric substance in the shape of a conical frustum. As shown in FIG. 3, the cylindrical grommet 18 is provided on one end 22 with a radially outwardly extending flange 24 and a radially inwardly tapering central aperture 26 extending longitudinally therefrom without passing entirely therethrough. The rigidity of the flange 24 is increased through placement of a metal ring 28 within an annular groove 30 formed therein. The central longitudinal aperture 26 is provided with a first and second internal circumferential groove 32 and 34, the second 34 of which is formed for most effective use at the extreme bottom of the aperture 26.

Figure 4:
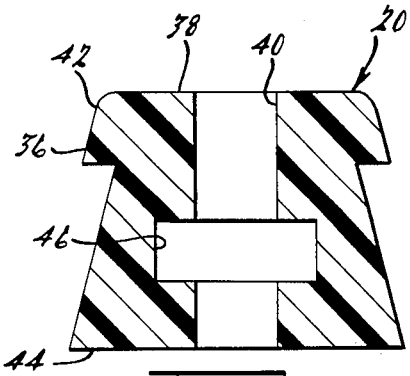
FIG. 4 is a view in cross section of the insert of the plug assembly of FIG. 2.

FIG. 4 shows the frusto-conical insert 20 having a radially outwardly extending flange 36 at its narrower end 38 and a central aperture 40 extending longitudinally therethrough. The circumferential surface 42 of the flange 36 is tapered radially inwardly so as to facilitate the insertion thereof into the central longitudinal aperture 26 of the grommet 18. The length of the insert 20 is sufficient to position the wider end 44 thereof flush with the flanged end 22 of the grommet 18 when fully inserted therein, as shown in FIG. 2. The central aperture 40 of the insert 20 allows air to escape during assembly, and may be provided with a radially outwardly extending portion, such as an internal circumferential groove 46, to further facilitate automated handling of the plug assembly 16 therewith.

Figure 5:
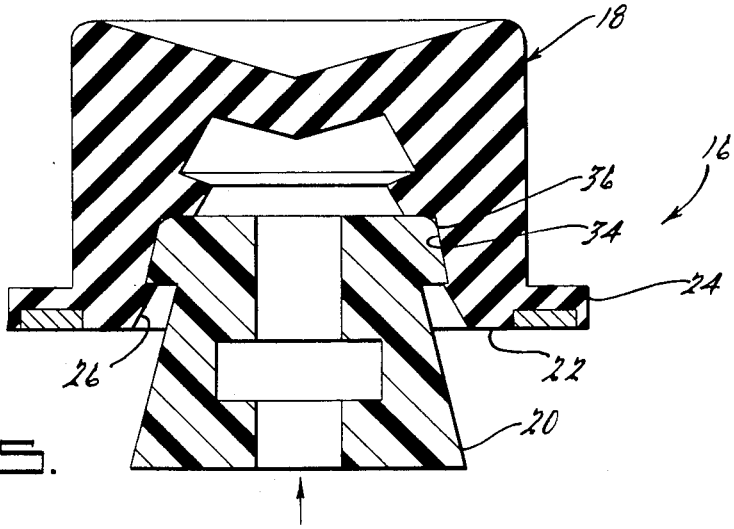
FIG. 5 is a view in cross section of the plug assembly prior to insertion into the engine block port.

The insert 20 is preassembled with the grommet 18 prior to installation into the engine block port 14 formed with a back angle, preferably between 10° and 15°, or an internally facing counterbore. As illustrated in FIG. 5, the insert 20 is intromitted flange-first into the central aperture 26 of the grommet 18 so as to position the flange 36 thereof securely within the first internal groove 32 of the aperture 26. The plug assembly 16 is then positioned within the engine block port 14 so as to place the flange 24 of the grommet 18 in contiguity with the outer surface 48 of the engine block 12. The grommet 18 is expanded radially outward by driving the insert 20 to the fully inserted position, wherein the insert 20 is locked by grommet resilience and by interaction between the flange 36 thereof and the second internal groove 34, as shown in FIG. 2.

Figure 6:
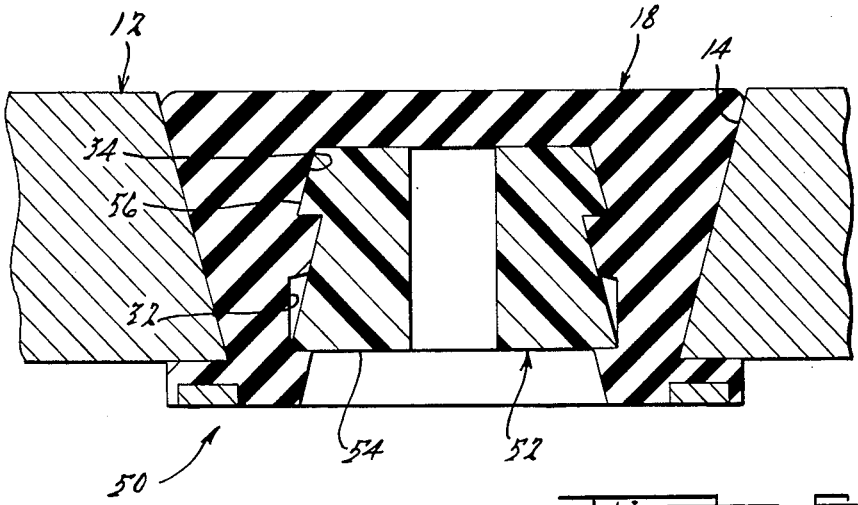
FIG. 6 is a view similar to that of FIG. 2 of an alternative embodiment of the engine block plug assembly of FIG. 2.

In an alternative embodiment 50 of the invention, shown in FIG. 6, the cylindrical grommet 18 is combined with a frusto-conical insert 52 that is similar to the insert 20 of FIG. 1 but for its longitudinal dimension, which is sufficient to cause engagement between the periphery of its wider end 54 and the first internal groove 32 upon full insertion thereof within the central aperture 26 of the grommet 18. The insert 52 is preassembled with the grommet 18 in the manner disclosed hereinabove, and the assembly 50 is positioned in the engine block port 14. The grommet 16 is expanded radially outward by driving the insert 52 to the fully inserted position, as shown in FIG. 6, wherein the insert 52 is locked by grommet resilience and by interaction between the radially outwardly extending flange 56 of the insert 52 and the second internal groove 34, and the periphery of the insert's wider end 54 and the first internal groove 32, respectively. The plug assembly 50 of FIG. 6 is thus able to withstand greater engine fluid pressures than the plug assembly 16 of FIG. 2 as there are two sets of longitudinally opposed surfaces maintaining the insert 52 within the central longitudinal aperture 26 of the grommet 18. This is particularly important in sealing the oil channels of an engine which achieve higher fluid pressures during cold engine starts.

Figure 7:
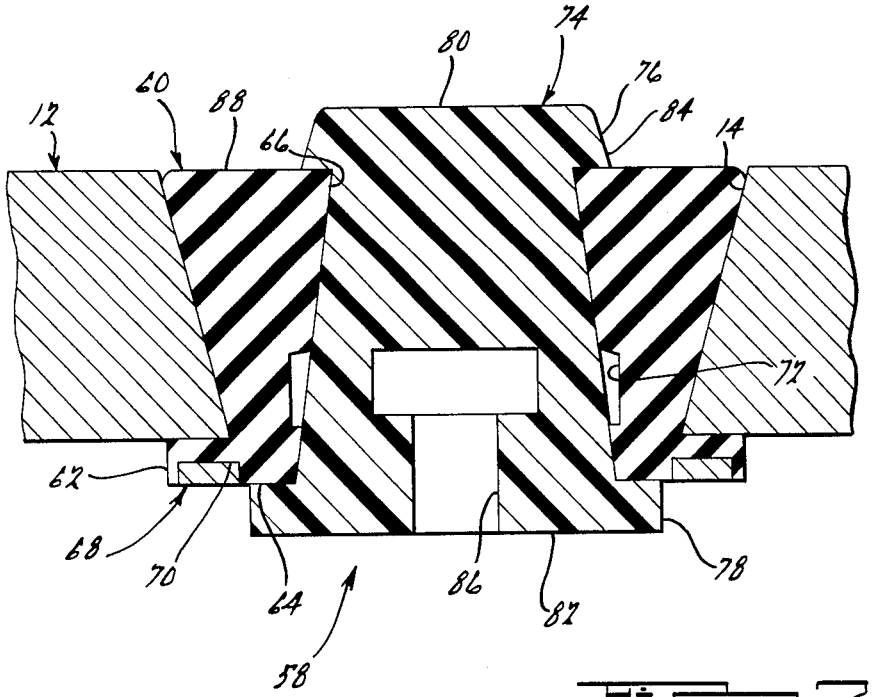
FIG. 7 is a view similar to that of FIG. 2 of a second alternative embodiment of the engine block plug assembly of FIG. 2.

A second alternative embodiment 58 of the invention, shown in FIG. 7, comprises a cylindrical grommet 60 having a radially outwardly extending flange 62 on one end 64 and a central longitudinal radially inwardly tapering aperture 66 extending entirely therethrough. The flange 62 incorporates a metal ring 68 within an annular groove 70 formed therein to increase its rigidity. The aperture 66 is provided with a single internal circumferential groove 72. A frusto-conical insert 74 has a radially outwardly extending flange 76 and 78 contiguous with each of its longitudinal ends 80 and 82. The circumferential surface 84 of the flange 76 on the narrower end 80 is tapered radially inwardly, facilitating the insertion thereof through the central longitudinal aperture 66 of the grommet 60. The insert 74 is provided with a central aperture 86 of suitable configuration to facilitate automated installation and extraction thereof from the grommet 60.

The insert 74 is preassembled with the grommet 60 in the manner disclosed hereinabove, with the flange 76 of the insert 74 positioned securely within the internal groove 72 of the grommet's aperture 66. The assembly 58 is positioned in the engine block port 14, and the grommet 60 is expanded radially outward by driving the insert 74 therethrough. The fully inserted position of the insert 74 is maintained by the resilience of the grommet material and by action of the insert's flanges 76 and 78 against the end surfaces 88 and 64, respectively, of the grommet 60. The plug assembly 58 is suitable for applications where a lower release pressure is desirable, since the exertion of fluid pressure directly upon the narrow end of the insert lowers the pressure required to dislodge it.

It is to be noted that, where the central longitudinal aperture 26 of the grommet 18 does not pass entirely therethrough, the end 90 of the grommet 18 opposite its flanged end 22 may be provided with a central depression 92 which does not intersect with the central longitudinal aperture 26 of the flanged end 22, as shown in FIG. 3. Thus, subsequent to radially outward expansion of the grommet 18 by the full insertion of the insert 20 therein, the opposite end 90 of the grommet 18 forms an essentially flat surface 94 that is flush with the inner surface 96 of the engine block 12, as shown in FIG. 2.

While the preferred embodiments of the invention has been disclosed, it should be appreciated that the invention is susceptible of modifications without departing from the spirit of the invention or the scope of the appended claims.

I claim:

1. A plug assembly for sealing a circular fluid port formed in an engine block comprising:

a cylindrical grommet formed of an elastic material having a radially outwardly extending flange and a central longitudinal radially inwardly tapering aperture with an internal circumferential groove;

an insert having a radially inwardly tapering outer surface defining a narrow end and a radially outwardly extending flange of like diameter as the internal groove of said grommet, said insert being preassembled with said grommet by inserting the narrow end thereof into the aperture of said grommet so as to position the flange thereof securely within the internal groove of said grommet, said assembly being introduced into said port so as to place the flange of said grommet in contiguity with said engine block and said grommet being expanded radially outwardly by further inserting said insert within the aperture of said grommet; and means for retaining said insert within the aperture of said grommet subsequent to the expansion thereof, whereby the expansion of said grommet is maintained and said port is sealed.

2. The plug assembly of claim 1 wherein the means for retaining said insert within the aperture of said grommet comprises placing a surface of said grommet in longitudinal opposition with the flange of said insert.

3. The plug assembly of claim 2 wherein the surface of said grommet in longitudinal opposition with the flange of said insert is defined by a second internal circumferential groove formed within the aperture of said grommet.

4. The plug assembly of claim 2 wherein the surface of said grommet in longitudinal opposition with the flange of said insert is defined by an end of said grommet.

5. The plug assembly of claim 2 wherein the surface of said grommet in longitudinal opposition with an end of said insert is defined by a second internal circumferential groove formed within the aperture of said grommet.

6. The plug assembly of claim 1 wherein the means for retaining said insert within the aperture of said grommet comprises placing a surface of said grommet in longitudinal opposition with an end of said insert.

7. The plug assembly of claim 1 wherein the means for retaining said insert within the aperture of said grommet comprises the resilient contraction of said grommet about said insert.

8. The plug assembly of claim 1 wherein said insert has a central longitudinal aperture to permit air to escape from within the aperture of said grommet while inserting said insert therein.

9. The plug assembly of claim 1 wherein the insert has a central longitudinal aperture to facilitate automated installation of said assembly into said port.

* * * * *